US007171893B1

(12) United States Patent
Robertson

(10) Patent No.: US 7,171,893 B1
(45) Date of Patent: Feb. 6, 2007

(54) ROTARY PRESS

(76) Inventor: Gary Robertson, 1100 E. Main St., Jonesborough, TN (US) 37659

( * ) Notice: Subject to any disclaimer, the term of this patent is extended or adjusted under 35 U.S.C. 154(b) by 0 days.

(21) Appl. No.: 10/868,850

(22) Filed: Jun. 17, 2004

(51) Int. Cl.
*B30B 3/06* (2006.01)

(52) U.S. Cl. ..... 100/157; 100/121; 100/145; 100/160; 100/171; 241/228

(58) Field of Classification Search ..... 100/117, 100/121, 145, 157, 177, 215, 905, 907, 160; 241/228; 99/501–505, 510–513
See application file for complete search history.

(56) References Cited

U.S. PATENT DOCUMENTS

| | | | | |
|---|---|---|---|---|
| 1,655,333 | A | | 1/1928 | Perazio |
| 2,715,871 | A | | 8/1955 | Dosne et al. |
| 2,795,184 | A | | 6/1957 | Graham et al. |
| 3,000,294 | A | * | 9/1961 | Lowe et al. ..... 100/121 |
| 3,220,340 | A | | 11/1965 | Frykhult |
| 3,592,129 | A | | 7/1971 | List |
| 4,355,573 | A | | 10/1982 | Berry |
| 4,491,067 | A | | 1/1985 | Kipelainen et al. |
| 4,566,381 | A | | 1/1986 | Nikulainen |
| 5,628,247 | A | * | 5/1997 | Palumbo et al. ..... 99/509 |
| 5,768,987 | A | | 6/1998 | Saalasti |

* cited by examiner

*Primary Examiner*—Lowell A. Larson
*Assistant Examiner*—Jimmy Nguyen
(74) *Attorney, Agent, or Firm*—Hoffman, Wasson & Gitler, P.C.

(57) ABSTRACT

A rotary press is supported on a frame allowing liquid and solid receivers to be placed underneath the rotary press. The rotary press has an outer ring and an inner drum. The inner drum has an upper and lower flange with a stripper ring retained between these flanges. The flanges form two sides of the cavity where the pressing takes place. The flanges carry the solids away from the pressing zone to a discharge zone where the stripper ring expels the solids. By transporting the solids away from the pressing zone where liquids are expelled, reabsorption of the liquid is avoided. The stripper ring can move relative to the two flanges and is biased against the outer ring by the inner ring. The stripper ring applies pressure to the material to be processed and also pushes solid material from between the upper and lower flanges to fall into a receiver for the solids.

13 Claims, 10 Drawing Sheets

ROTARY PRESS

BACKGROUND OF THE INVENTION

Presses are used to apply pressure to solid-liquid mixtures to separate the two components from each other. Separation of the components is preferable for the proper recycling, reuse, or disposal of the two components. A typical type of press includes two plates brought together under pressure, with the material to be treated disposed between them. This type of press is an incremental process as the material has to be brought between the two plates and stopped while the two plates are brought together with the liquid exiting the material under the pressure of the plates. After pressing, the remaining solid material is removed from between the plates. This type of press is not advantageous for treating a stream of material on a continuous basis.

Another type of press uses the interior surface of a large drum and an exterior surface of a smaller drum placed within the larger drum to form two surfaces between which material is squeezed.

Once such device is disclosed in U.S. Pat. No. 2,795,184 (Graham et al.). Graham et al. disclose a outer drum 1 and inner drum 2 receiving material from a horn-shaped stationary chamber 4 leading to the pinchpoint between the outer and inner drum. Liquid material passes through the drums into a pair of troughs 13, 14. Pressed cake falls away from the drums after passing through the pinchpoint.

Another rotary press is disclosed in U.S. Pat. No. 4,491,067 (Kipelainen et al.). Kipelainen et al. discloses a rotatable dewatering drum with a eccentrically-located press roll within the drum. The outside surface of the press roll and the inner surface of the drum define a press gap.

U.S. Pat. No. 1,655,333 (Perazio) discloses a fruit crusher and squeezer having a crushing ring 7 driven by pinions 15 and 16 connected to handwheel 18. Fruit placed within the crusher and squeezer is pressed between crushing ring 7 and crushing and squeezing roller 21.

Besides the use of presses, thermal methods of evaporating liquids are used to remove liquids from solids.

There is a need in the prior art for a rotary press removing substantially all the liquid from a solid.

It is an object of the invention to provide a rotary press able to remove substantially all of the liquid from a solid in a single pressing.

It is another object of the invention to provide a press having exits for liquid and solids spaced from one another.

It is another object of the invention to provide a press having an outer ring and inner drum, the inner drum having movable parts to allow for both maximum pressure to be applied to the material being processed and to transport the solid after pressing into an exit spaced from the liquid exit.

It is another object of the invention to provide a rotary press that is portable and inexpensive.

It is another object of the invention to provide a rotary press that is simple to operate, yet effective in removing liquids from solids.

It is yet another object of the invention to avoid the reabsorption of liquids of liquids by the solids after pressing.

It is still another object of the invention to provide a method of removing liquids from solids that is cheaper than thermal methods.

It is another object of the invention to reduce the amount of liquids being disposed of in landfills.

These and other objects of the invention will become apparent to one of ordinary skill in the art after reviewing disclosure of the invention.

SUMMARY OF THE INVENTION

A rotary press is supported on a frame allowing liquid and solid receivers to be placed underneath the rotary press. The rotary press has an outer ring and an inner drum. The inner drum has a load wheel, an upper and lower flange with a stripper ring retained between these flanges. The flanges form two sides of the cavity where the pressing takes place. The flanges carry the solids away from the pressing zone to a discharge zone where the stripper ring expels the solids. By transporting the solids away from the pressing zone where liquids are expelled, reabsorption of the liquid is avoided. The stripper ring can move relative to the two flanges and is biased against the outer ring by the load wheel. The stripper ring applies pressure to the material to be processed and also pushes solid material from between the upper and lower flanges to fall into the receiver for the solids.

DETAILED DESCRIPTION OF THE INVENTION

Figure 1:
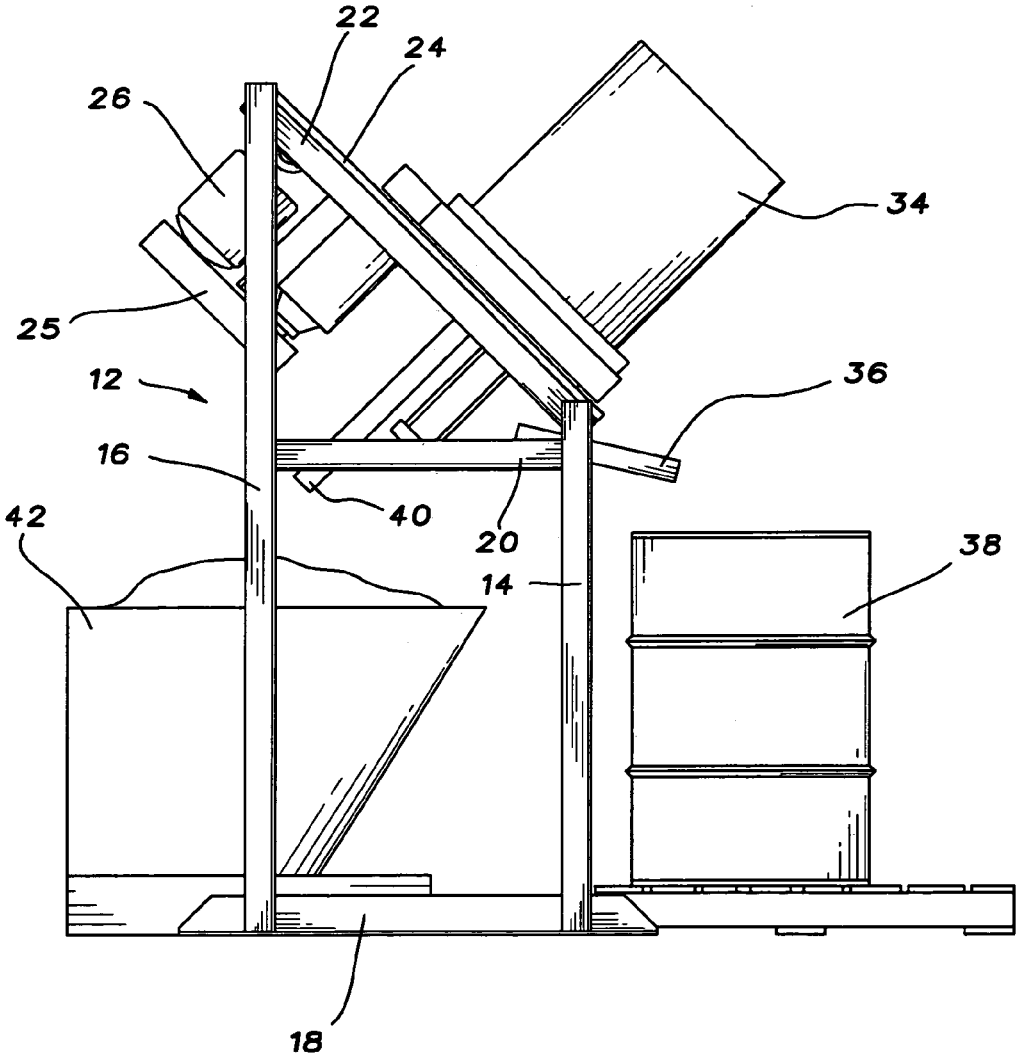
FIG. 1 is a side view of the rotary press.

The rotary press is seen in the side view of FIG. 1. The rotary press is supported upon a frame 12 having front legs 14 and rear legs 16. Lower cross-members 18 and upper cross-members 20 extend between the front and rear legs to provide rigidity. Frame 12 also supports motor 26, reducer 27 and diagonal supports 22. Driving gear 28 engages the rotary press and is connected to a reducer 27. The reducer is powered by the motor 26 by a belt drive 25. Table 24 rests upon the diagonal supports 22, at a 45° angle. Extending from the frame is a liquid chute 36 leading to liquid receiver 38 and solid chute 40 leading to solid receiver 42.

Figure 2:
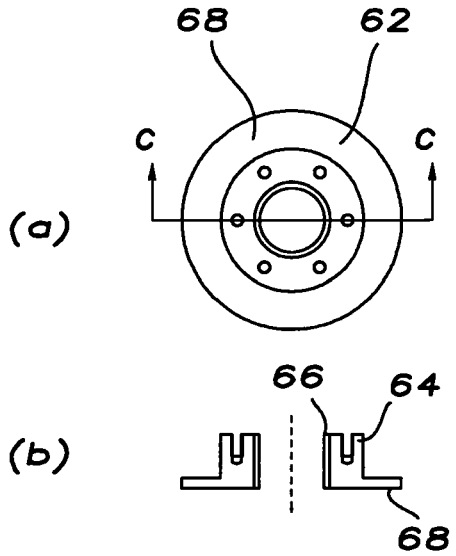
FIG. 2*a* is a top view of the inner ring.
FIG. 2*b* is a cross-section of the inner ring.

The inner drum is formed by three pieces. The first piece is inner ring 62, seen in FIG. 2. The inner ring 62 has load wheel 64 and outwardly extending lower flange 68. As seen in the cross-sectional view of FIG. 2*b*, the inner ring has a central bore lined with bushing 66, made of low friction material such as oil impregnated bronze, and the load wheel 64 has six bolt holes.

Figure 3:
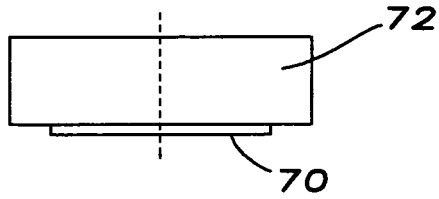
FIG. 3 is a side view of the removable flange.

The second piece is removable flange 70 having six bolt holes which register with the bolt holes of the inner ring. As seen in FIG. 3, blades 72 extend outwardly from the center of the removable flange 70, the purpose of these blades being discussed later. Any number of blades may be used but six blades, one extending between each pair of bolt holes, is illustrated. The removable flange 70 has essentially the same size and shape as lower flange 68.

Figure 4:
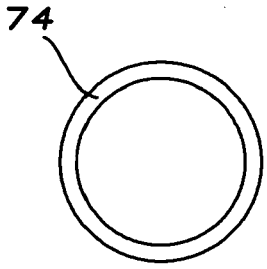
FIG. 4 is a top view of the stripper ring.
Figure 5:
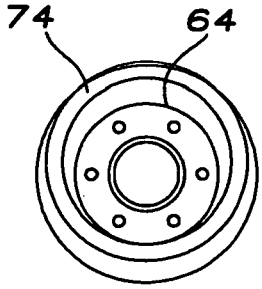
FIG. 5 is a top view of the inner drum with the stripper ring and inner ring shown in phantom.

The stripper ring 74, placed between the upper and lower flange, is seen in FIG. 4. A better understanding of the arrangements of the three parts making the inner drum is seen in FIG. 5, a top view of the inner drum. As will be explained later, the load wheel 64 is biased against the inner surface of the stripper ring 74. When, in this position, the outer surface of the stripper ring 74 at a point diametrically opposed to the point of contact between the load wheel 64 and inner surface of the stripper ring 74 is tangent to the outer edge of the upper and lower flanges. A crescent-shaped section of the upper and lower flanges is produced with its maximum width being at the point of contact between the load wheel 64 and stripper ring 74 and gradually decreasing. The purpose of this crescent-shaped section will be explained later. The lower flange is provided with drainage holes to expedite the drainage of the relaeased fluids.

Figure 6:
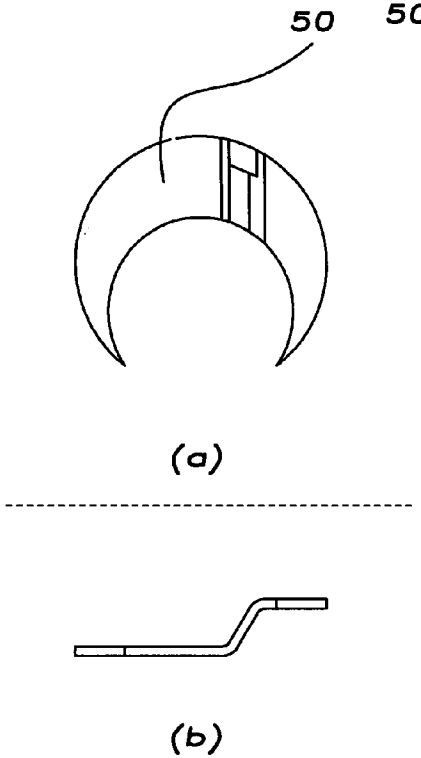
FIG. 6*a* is a top view of the divider plate.
FIG. 6*b* is a front view of the divider plate.

Clearly seen in FIG. 6*a* is the bi-level aspect of the divider ring. The divider ring has a lower section 52, an upper section 56, substantially parallel to the lower section, and a slope 54 connecting the upper and lower section. FIG. 6*b* shows the top of a divider plate 50. As seen in a top view, the divider plate has a crescent shape with an outer surface having a radius of curvature slightly larger than the inner surface of the outer ring and an inner surface having the same radius of curvature as the outer surface of the lower flange. As such, the divider plate serves as a bridge between the outer ring and lower flange. The slope has notch 55 allowing for the passage of solids that will not compress.

Figure 7:
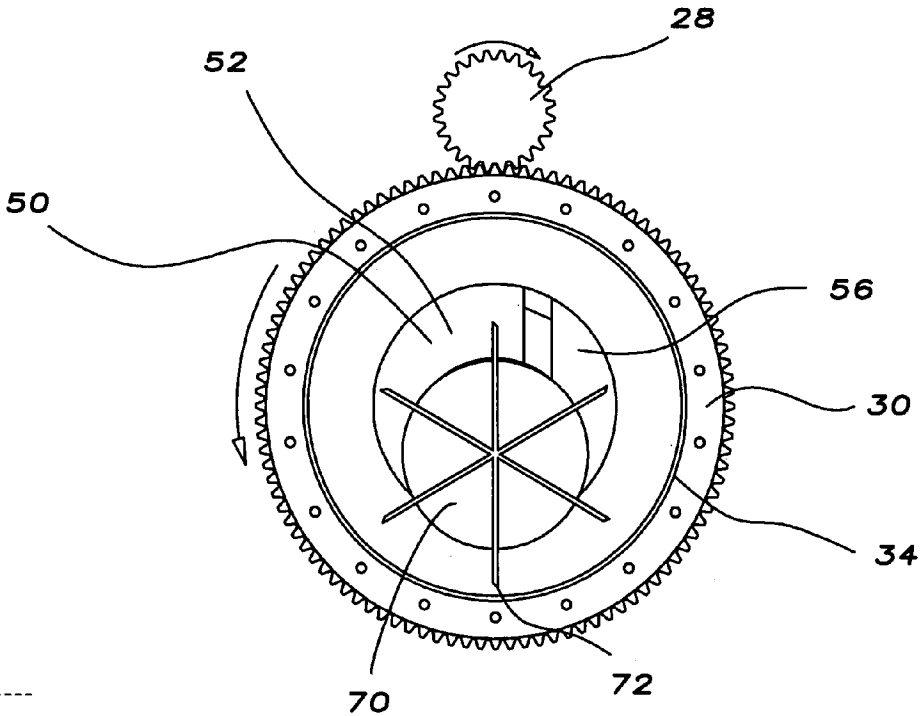
FIG. 7 is a top view of the outer ring and inner drum.

The interaction between the various parts of the rotary press are seen in FIG. 7. The outer ring 30 is provided with outwardly extending gear teeth meshing with driving gear 28 to cause counterclockwise rotation of the outer ring. Attached to and extending upwardly from the outer ring is hopper 34. Upper flange 70 extends slightly over the outer ring 30 when the stripper ring and inner load wheel are biased against the inner surface of the outer ring 30. Bridging the gap between the lower flange and inner surface of the outer ring is the divider plate. Also seen is blade 72 extending from the removable flange 70 and in close proximity to the hopper 34. The blades perform two functions, serving to break up large pieces of material, held cohesive by liquid and also pushing material to be processed on the outer ring 30 onto divider plate 50 where it is moved towards the contact area between the stripper ring and outer ring 30.

Figure 8:
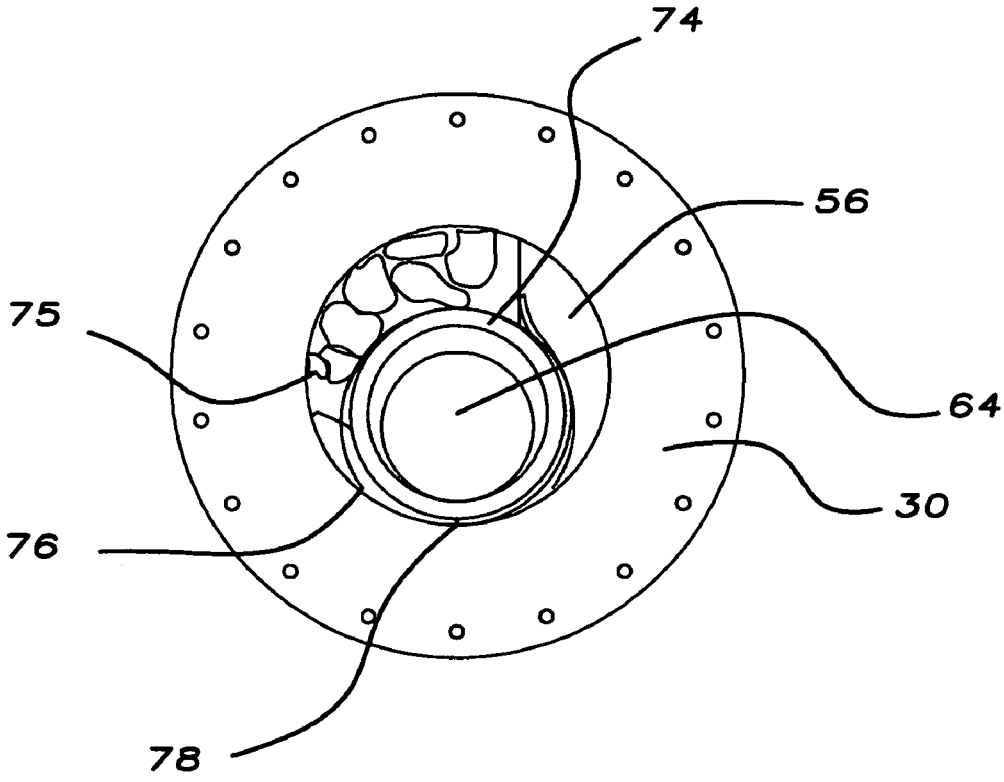
FIG. 8 is a top view of the outer ring and inner drum in operation.

The pressing operation between the stripper ring 74 and outer ring 30 is seen in FIG. 8. Material on the divider plate 50 is moved towards the convergence of the stripper ring and outer ring, first through a packing zone 75 where air is removed from the material to be processed. Thereafter, the material enters a pressing zone where liquid begins to be expressed from the material. The material continues onto the exit zone, the point of closest distance between the stripper ring and outer ring. The solid material is retained on the crescent-shaped area defined between the outer edge of the flanges and the outer surface of the stripper ring, discussed with reference to FIG. 5. As the material rotates with the stripper ring, the crescent-shaped area becomes smaller and the stripper ring pushes the material out from between the flanges. The material goes under the upper section 56 of the divider plate, through a discharge area and then exits the press.

Figure 9:
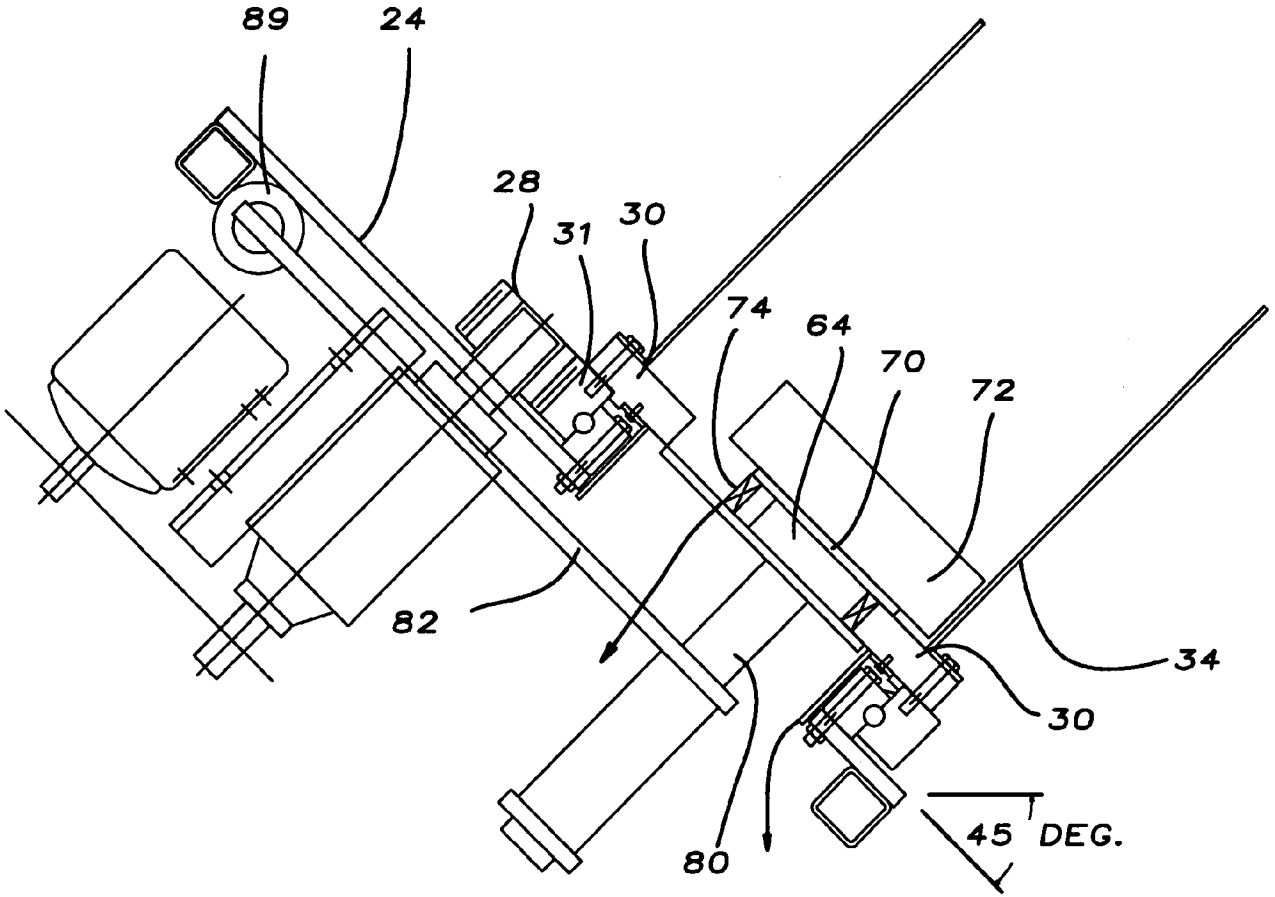
FIG. 9 is a cross-section of the rotary press.

Further details of the pressing operation can be seen with reference to FIG. 9. In this view, the stripper ring 74 is pressed up against the outer ring 30. In use, material being pressed is located between these two pieces, the inner ring and stripper ring being pushed against its bias, which will be explained later. As seen in this view, the stripper ring has the same height as the outer ring, allowing the flanges 68 and 70 to extend over the outer ring. Also seen is the distance between the stripper ring and load wheel 64 when the edge of the stripper ring 74 is aligned with the edge of the flanges as the stripper ring is pinched between the load wheel 64 and outer ring 30.

The outer ring is connected to the outside of a slewing ring 31 with the inside of the slewing ring connected to the table 24. A driving gear 28 engages teeth on the outer surface of the slewing ring to rotate the hopper. The stripper ring and inner ring are biased against the outer ring so as to rotate at the same speed. The inner ring can be provided with its own motor causing the inner ring and outer ring to rotate at different speeds. This differential in speed produces a grinding action in addition to the pressing action.

Figure 10:
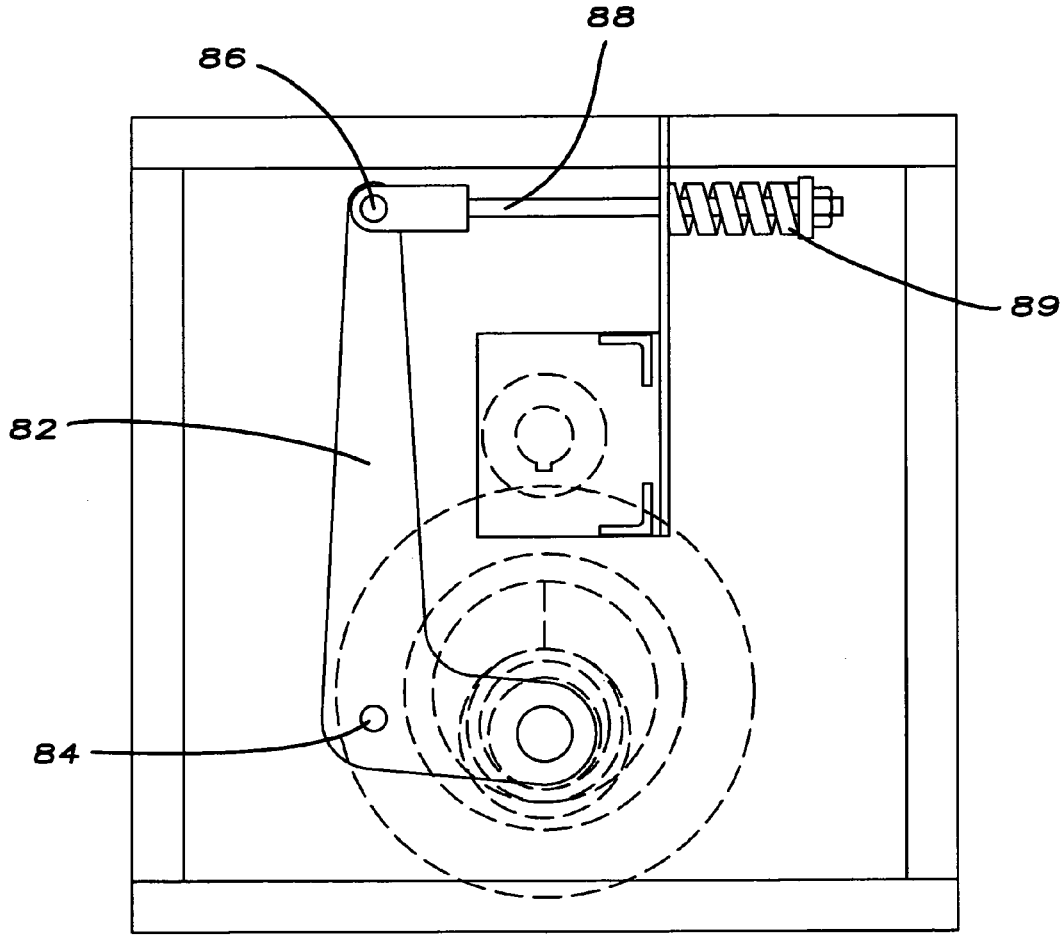
FIG. 10 is a top view of the support and loading mechanism for the inner drum.

The ability of the stripper ring to apply pressure against the outer ring 30 is essential to the function of the press. The mechanism for applying pressure is seen in FIG. 10. An L-shaped arm 82 having a pivot 84 has one end attached to a spindle 80 extending to the inner ring. The other end of the L-shaped arm 82 has a pivot connection 86 to connecting rod 88. A spring 89 applies force on the connecting rod, drawing the pivot connection 86 closer to the spring. This force, in turn, urges the inner ring outwardly, towards the front of the press. This outward force causes the load wheel to press against the stripper ring, keeping it in contact with the outer ring.

Figure 11:
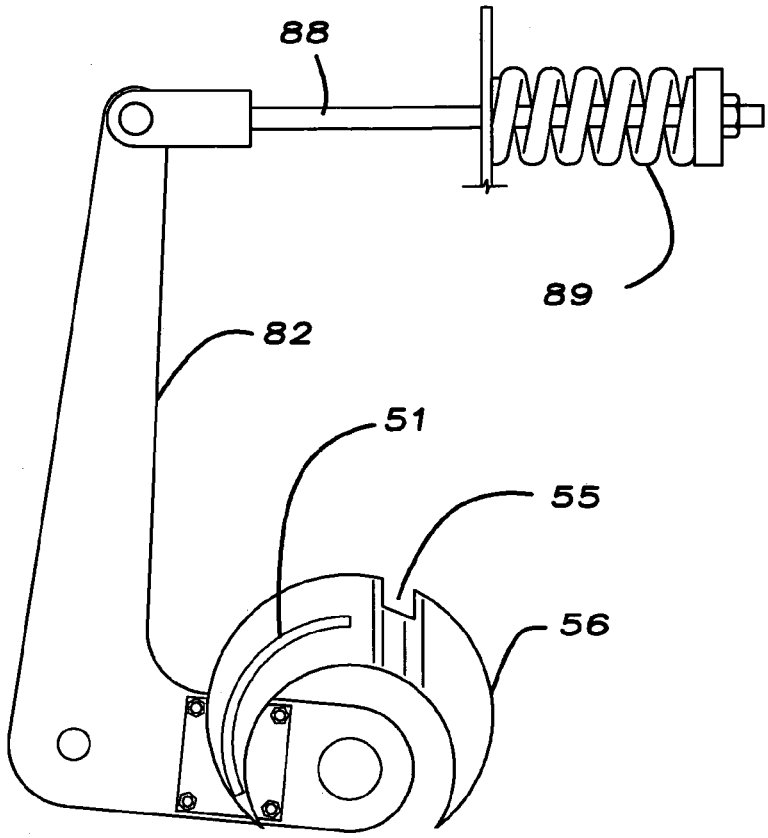
FIG. 11 is a top view of the support for the divider plate.
Figure 12:
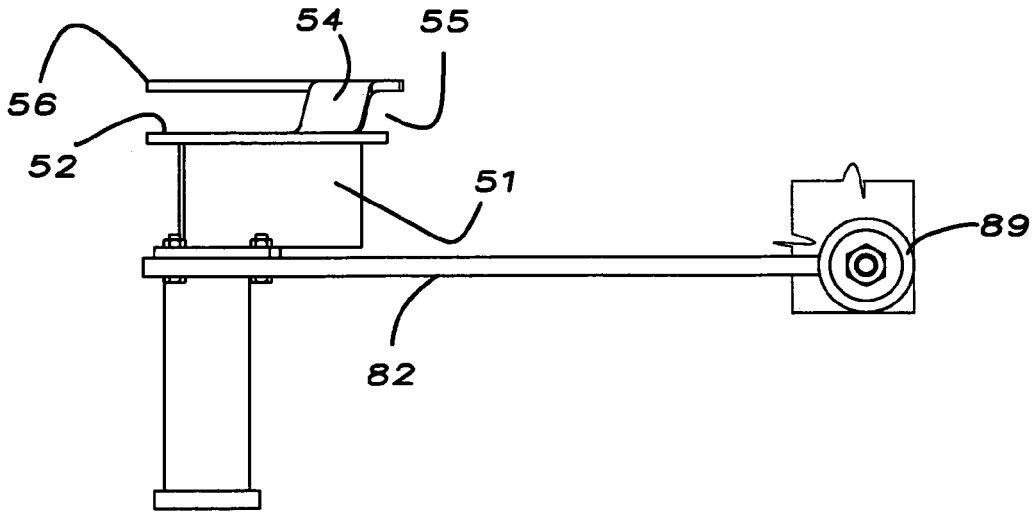
FIG. 12 is a side view of the support for the divider plate.

FIG. 11 shows the relationship between the divider plate 50 and the L-shaped arm 82. A support 51 extends upwardly from the L-shaped arm, attaching to the bottom of the divider plate. The side view of FIG. 12 shows the support 51 and the placement of relief notch 55 allowing the mechanism to open and pass solids due to the resiliency of the support 51.

Figure 13:
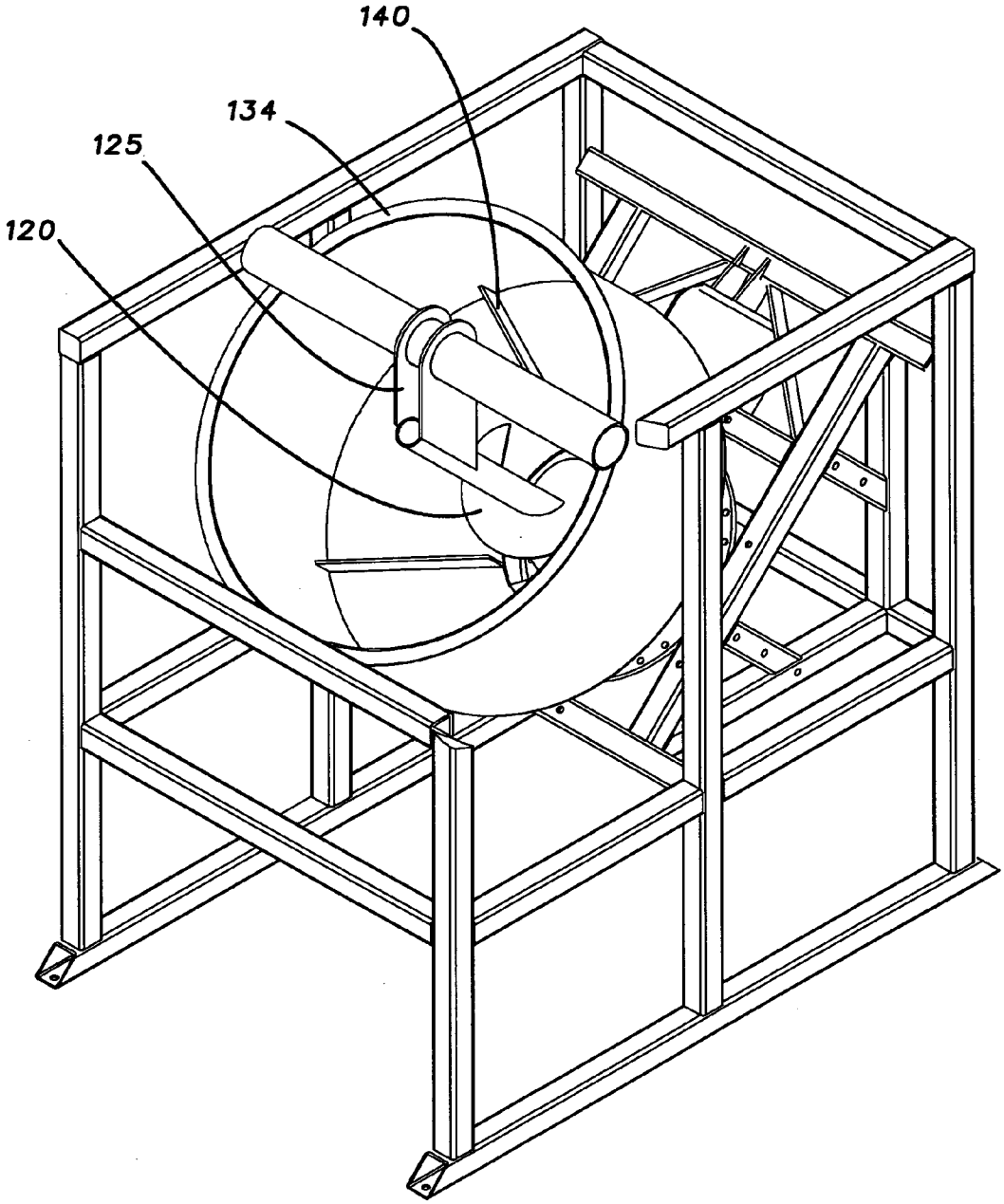
FIG. 13 shows a second embodiment of the hopper and removable flange.
Figure 14:
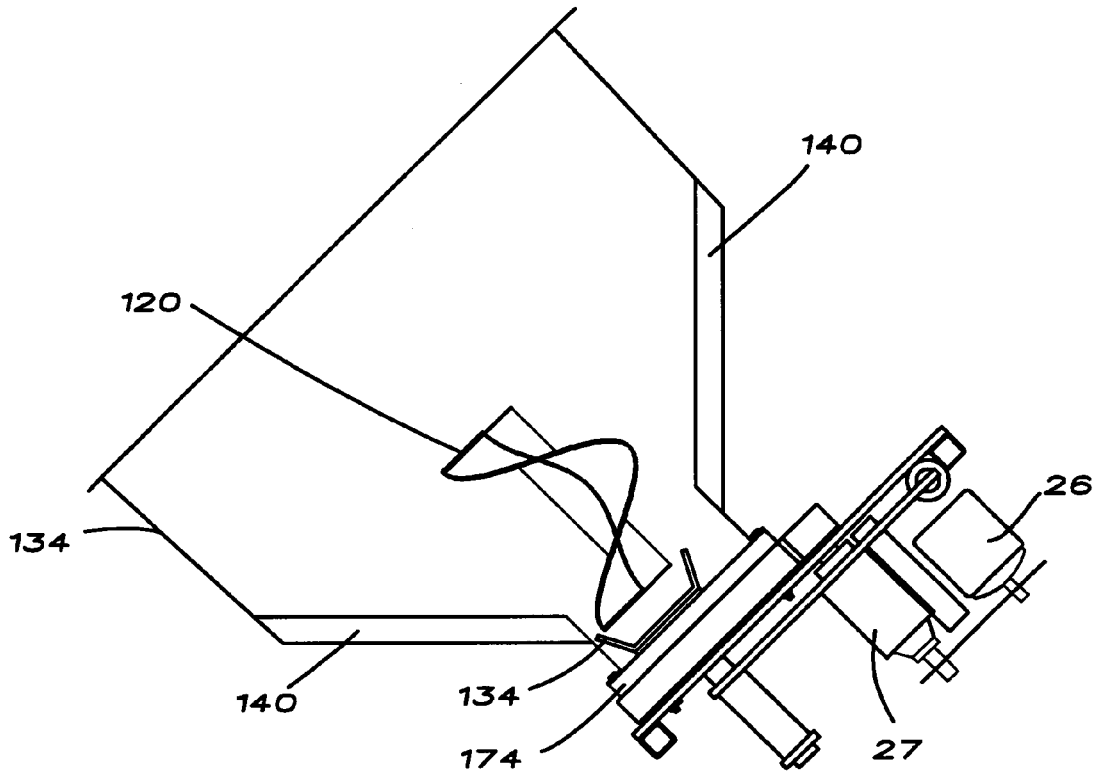
FIG. 14 depicts a side view of the hopper of FIG. 13.

FIG. 13 shows the press and table mounted upon a frame. An auger 120, connected to the frame by support 125 extends downwardly into the hopper. As the hopper is turned by the motor, the auger remains still, leading to relative motion between the auger and the contents of the hopper. A series of lifters 140 extending from the sidewalls of the hopper 134 further enhance the movement of the material towards the press. A side view of the auger, with support 125 removed for clarity, can be seen in FIG. 14. The hopper 134 has an upper cylindrical section with a lower conical section. The lifters 140 extend from the inner surface of the conical section. The lifters 140 are plates extending upwardly from the side wall and may be permanently or removably attached. The advantage of removably attaching the lifters is the ability to use lifters of different design depending upon the material to be pressed. In addition to plates, the lifters may be a series of rods extending upwardly from the side wall. The rods may be connected to a base plate which is removably attached to the hopper in order to install and uninstall the rods in an efficient manner. The auger 120 extends downwardly to near the top of the upper flange. Connected to the top of the upper flange is single blade 134 formed by a steel rod having its end bent upwardly at an angle and a middle section connected to the upper flange.

Figure 15:
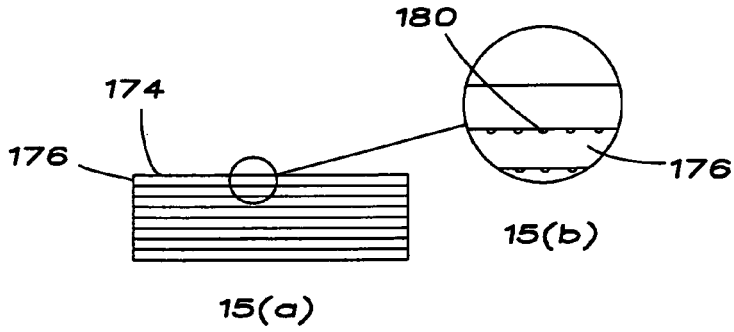
FIG. 15A is a side view of an alternative embodiment of the stripper ring.
FIG. 15B is a detailed view of the stripper ring of FIG. 15.

Besides a smooth surface, the stripper ring can be provided with a textured surface to enhance the function of the upper ring or be provided with openings allowing the removal of the liquid content. FIG. 15*a* shows a stripper ring 174 formed by a plurality of rings 176 stacked on one another. Each ring has a series of rivet holes. When the various rings are stacked, one on the other, the holes are put in registry and rivets extend through the holes to form the stripper ring 174.

As can be seen with respect to FIG. 15*b*, the top edge of each ring, except for the top ring, is provided with filter hole openings 180. The filter hole openings allow liquid to pass but is such a size as to prevent particles which would cause clogging to pass.

Figure 16:
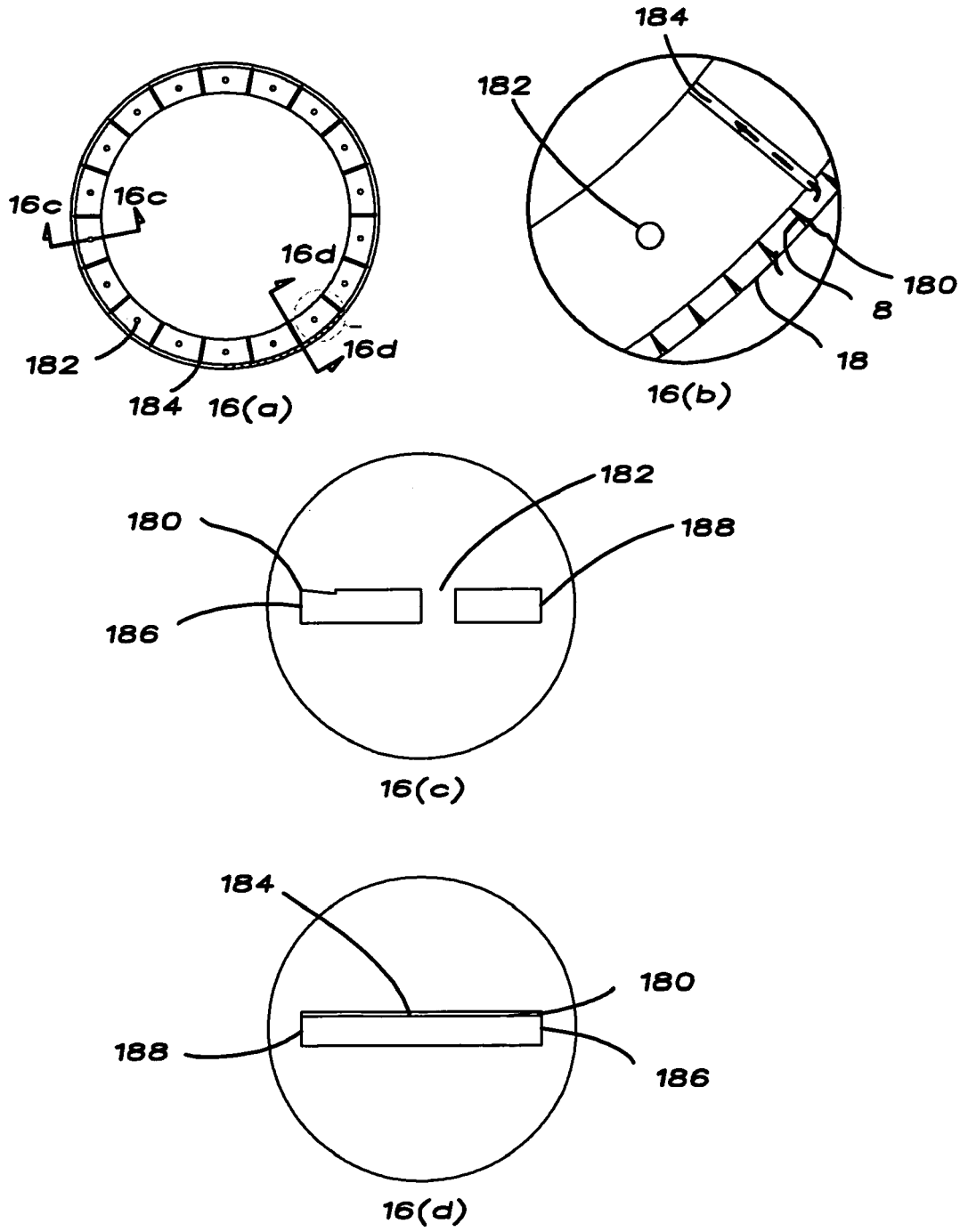
FIG. 16A is a top view of one of the rings used to make the stripper ring of FIG. 15.
FIG. 16B is a detailed view of the top surface of FIG. 16A.
FIG. 16C is a cross-sectional view along line I—I of FIG. 16A.
FIG. 16D is a cross-sectional view along line II—II of FIG. 16A.

FIG. 16A shows a top view of one of the rings 176 used to make the stripper ring, when stacked upon each other. Seen here are the rivet hole 182. Between each rivet hole is an oil discharge channel 184 which will be described later. FIG. 16B shows a detailed view of a section of the top surface of the stripper ring. The solid material S is pressed against the outside surface 186 of the stripper ring and liquid is forced into the filter hole 180. Liquid entering the filter hole plows a path to the oil discharge channel 184 on the inside surface 188 of the stripper ring.

FIG. 16C is a cross-section of the ring through line I—I of FIG. 16A. This view cuts through the rivet hole 182. Seen here is the filter hole opening formed in the top edge of the ring. When another ring is placed on top of the first ring, the filter hole opening is formed.

FIG. 16D is a cross-sectional view along line II—II of FIG. 16A and cuts through an oil escape channel. In this view, the filter hole opening is in communication with the oil escape channel, located slightly below the top edge of the ring.

As can be appreciated, the various features of the two embodiments may be used with each other. For instance, the hopper 134 having a cylindrical and conical section may be used with the embodiment shown in FIG. 1.

While the invention has been described with reference to a preferred embodiment, variations and modifications would be apparent to one of ordinary skill in the art. The invention encompasses such variations and modifications. For instance, the top flange may be formed as one piece with the load wheel which is removably attached to the bottom flange.

I claim:

1. A rotary press, comprising:

an outer ring having an outer surface and an inner surface, an inner drum eccentrically located within said outer ring, said inner drum having an outer surface, a divider plate extending from said outer ring inner surface to said inner drum outer surface, said divider plate having a lower section, an upper section and a middle section extending between said upper and lower sections, said middle section inclined relative to said lower section, wherein said upper section and middle section define a discharge opening for solid material.

2. The rotary press of claim 1, wherein said divider plate is crescent-shaped.

3. The rotary press of claim 1, wherein said upper section and lower section are parallel.

4. A rotary press, comprising:

an outer ring having an inner surface, an outer surface, an upper surface and a lower surface, an inner drum eccentrically located within said outer ring, said inner drum comprising:

a top flange, a bottom flange, and a stripper ring retained between said top and bottom flanges and biased against said inner surface of said outer ring, a load wheel extending between said top and bottom flanges and within said stripper ring, said load wheel biasing said stripper ring against said outer ring.

5. The rotary press of claim 4, further comprising:

a spindle attached to said load wheel, a spring biasing said spindle to cause said load wheel to contact said outer ring.

6. The rotary press of claim 5, further comprising: a frame supporting said outer ring, an L-shaped arm connected to said spindle, one end of the L-shaped arm pivotally connected to a connecting rod, said spring acting between said frame and said connecting rod.

7. The rotary press of claim 4, wherein:

said stripper ring has a smaller diameter than said flanges, wherein said load wheel is biased against said stripper ring at a first point, the outer surface of said stripper ring overlies the edges of said top and bottom flanges at a second point diametrically opposed to said first point.

8. The rotary press of claim 4, wherein said top flange is removably connected to said load wheel.

9. A rotary press, comprising:

an outer ring having an inner surface, an outer surface, an upper surface and a lower surface, an inner drum eccentrically located within said outer ring, said inner drum comprising:

a top flange, a bottom flange, and a stripper ring retained between said top and bottom flanges and biased against said inner surface of said outer ring, a frame supporting said outer ring, a hopper extending upwardly from said outer ring for holding material to be pressed, an auger connected to said frame by a support, said auger extending into said hopper.

10. The rotary press of claim 9, wherein said hopper has a lower conical section and an upper cylindrical section.

11. The rotary press of claim 10, further comprising:

lifters on said inner surface hopper lower conical section.

12. The rotary press of claim 11, wherein:

said lifters comprise plates.

13. The rotary press of claim 11, wherein:

said lifters are removably attached to said hopper.

* * * * *